United States Patent [19]

Uesawa et al.

[11] Patent Number: 4,840,889

[45] Date of Patent: Jun. 20, 1989

[54] HIGH WHITENESS SILVER HALIDE PHOTOGRAPHIC PAPER FOR DIRECT POSITIVES

[75] Inventors: Yutaka Uesawa; Isamu Morimoto, both of Hino, Japan

[73] Assignee: Konishiroku Photo Industry Co., Ltd., Tokyo, Japan

[21] Appl. No.: 93,821

[22] Filed: Sep. 8, 1987

[30] Foreign Application Priority Data

Sep. 11, 1986 [JP] Japan ..... 61-214658
May 1, 1987 [JP] Japan ..... 62-108138

[51] Int. Cl.[4] ..... G03C 1/36; G03C 1/92

[52] U.S. Cl. ..... 430/597; 430/523; 430/933

[58] Field of Search ..... 430/523, 597, 933, 940

[56] References Cited

U.S. PATENT DOCUMENTS

| | | | |
|---|---|---|---|
| 3,359,102 | 12/1967 | Pattijn et al. | 430/635 |
| 3,418,127 | 12/1968 | Millikan | 430/139 |
| 3,449,257 | 6/1969 | Tuite et al. | 430/933 |
| 3,505,070 | 4/1970 | Litzerman et al. | 430/597 |
| 3,558,316 | 1/1971 | Keberle et al. | 430/933 |
| 3,592,645 | 7/1971 | Weyerts et al. | 430/933 |
| 3,788,854 | 1/1974 | Tuite | 430/933 |
| 3,832,184 | 8/1974 | Sato et al. | 430/597 |
| 4,592,991 | 6/1986 | Yoshida et al. | 430/933 |

FOREIGN PATENT DOCUMENTS 54-104822 8/1979 Japan .

*Primary Examiner*—Richard L. Schilling
*Attorney, Agent, or Firm*—Frishauf, Holtz, Goodman & Woodward

[57] ABSTRACT

Silver halide photographic paper for direct positives, comprising a support and a silver halide emulsion layer for direct positives, provided on the support and containing silver halide grains having been fogged in the presence of a reduction fogging agent and a water-soluble gold compound, wherein a photographic layer on the side on which said silver halide emulsion layer for direct positives is provided contains an emulsion dispersion or latex dispersion of an oil-soluble brightening agent, and simultaneously contains at least one of organic desensitizers represented by formula (I), (II), (III), (IV) or (V) as shown in the specification.

12 Claims, No Drawings

HIGH WHITENESS SILVER HALIDE PHOTOGRAPHIC PAPER FOR DIRECT POSITIVES

BACKGROUND OF THE INVENTION

This invention relates to silver halide photographic paper for direct positives, and more particularly to silver halide photographic paper for direct positives which has high sensitivity and improved whiteness.

Recent years, fogged silver halide photographic papers for direct positives have a trend toward achievement of higher sensitivity. To achieve higher sensitivity, it is necessary to obtain sufficient development activity with impartment of fog as little as possible, and accordingly there has been advantageously used a method of imparting fog in the presence of a reduction fogging agent and a water-soluble gold compound.

As example of the method for imparting fog, there may be mentioned those described in U.S. Pat. No. 3,501,305, No. 3,501,306 and No. 3,501,307, etc.

On the other hand, as other methods for enhancing the sensitivity of fogged silver halide photographic paper for direct positives, there has widely been used a method in which an organic desensitizer adsorbed on the surface of silver halide grains is used as an electron acceptor. The above organic desensitizers include, for example, compounds described in U.S. Pat. No. 2,930,694, No. 3,431,111, No. 3,492,123, No. 3,501,310, No. 3,501,312, No. 3,567,456 and No.3,582,343, etc.

Meanwhile, it is a well known technique to add a brightening agent to photographic layers in order to increase the whiteness of finished photographic paper, and widely used are water-soluble brightening agents described, for example, in U.S. Pat. No. 2,933,390, Japanese Patent Publication No. 30495/1973, Japanese Unexamined Patent Publication No. 135833/1980, etc.

However, it was found by the present inventors that the sensitivity may extremely decrease when the water-soluble brightening agent is added in the direct positive silver halide photographic paper containing silver halide grains having been fogged in the presence of the reduction fogging agent and water-soluble gold compound. It is possible to minimize the decrease in sensitivity by adding in photographic layers the water-soluble brightening agent previously adsorbed in a water-soluble polymer having the mordanting effect, such as polyvinyl pyrrolidone, but the above method has been still insufficient for resolving the problem described above. Such extreme decrease in sensitivity caused by addition of the water-soluble brightening agent is a phenomenon that has never been observed in silver halide photographic paper of a usual negative type.

SUMMARY OF THE INVENTION

Accordingly, an object of this invention is to provide silver halide photographic paper for direct positives, having high sensitivity and at the same time high whiteness.

The above object of this invention can be achieved by silver halide photographic paper for direct positives, comprising a support and a silver halide emulsion layer for direct positives, provided on the support and containing silver halide grains having been fogged in the presence of a reduction fogging agent and a water-soluble gold compound, wherein a photographic layer on the side on which said silver halide emulsion layer for direct positives is provided contains an emulsion dispersion or latex dispersion of an oil-soluble brightening agent, and simultaneously contains at least one of organic desensitizers represented by formula (I), (II), (III), (IV) or (V):

formula (I)

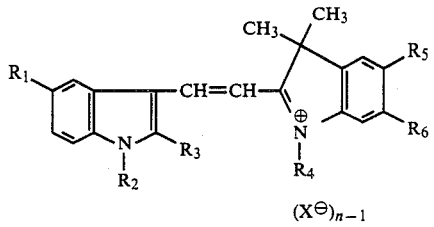

formula (II)

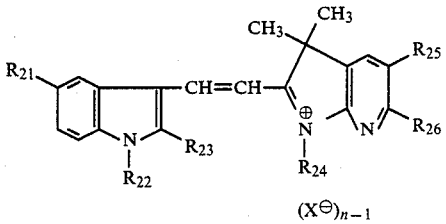

formula (III)

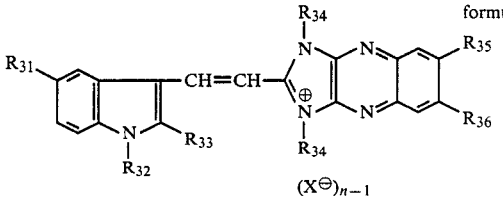

formula (IV)

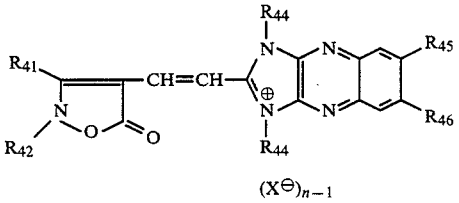

or formula (V)

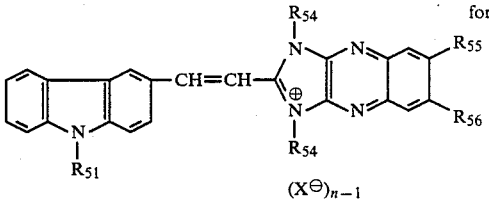

wherein $R^1$, $R^{21}$ and $R^{31}$ each represent a hydrogen atom, a halogen atom, an alkyl group, an alkoxy group, aryloxy group or a nitro group, $R^2$, $R^3$, $R^4$, $R^{22}$, $R^{23}$, $R^{24}$, $R^{32}$, $R^{33}$, $R^{34}$, $R^{44}$ and $R^{54}$ each represent an alkyl group, an alkenyl group, an aryl group or an aralkyl group, which may be unsubstituted or substituted, $R^5$, $R^6$, $R^{25}$, $R^{26}$, $R^{35}$, $R^{36}$, $R^{45}$, $R^{46}$, $R^{55}$ and $R^{56}$ each represent a hydrogen atom, a halogen atom, an alkyl group, an aryl group, a thienyl group, an alkoxy group, a hydoxy group, a cyano group, an alkylsulfonyl group, an alkoxycarbonyl group, a phenylsulfonyl group, a trifluoromethyl group, a trifluoromethylsulfonyl group or a nitro group, $R^{41}$ represents an aryl group, $R^{42}$ represents an alkyl group, $R^{51}$ represents an alkyl group which may be unsubstituted or substituted, $X^{\ominus}$ represents an anion and n represents 1 or 2 with proviso that in case where the compound forms an internal salt, n is 1.

DESCRIPTION OF PREFERRED EMBODIMENTS

The photographic layer mentioned in this invention is a generic term for light-sensitive layers and non-light-sensitive layers. The light-sensitive layers may specifically include a silver halide emulsion layer for direct positives, and a silver halide emulsion layer for direct positives that has been fogged in the presence of a reduction fogging agent and a water-soluble gold compound. The non-light-sensitive layers may specifically include a subbing layer, an intermediate layer and a protective layer.

The oil-soluble brightening agent used in this invention may advantageously include, for example, substituted stilbene and substituted coumarin described in British Pat. No. 786,234 and substituted thiophenes described in U.S. Pat. No. 3,135,762. Particularly advantageously usable are the brightening agents as disclosed in Japanese Patent Publication No. 38376/1970 and Japanese Unexamined Patent Publication No. 126732/1975.

Typically advantageous oil-soluble brightening agents include those having one of the following structural formulas (a) to (d):

(a)

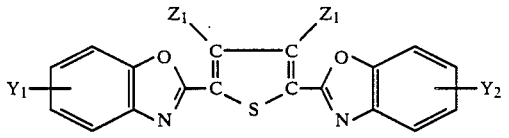

(b)

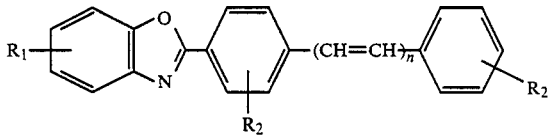

(c)

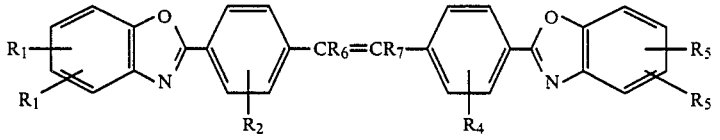

and (d)

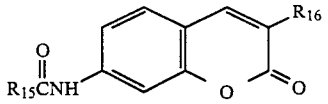

wherein $Y^1$ and $Y^2$ each represent an alkyl group, $Z^1$ and $Z^2$ each represent a hydrogen atom or an alkyl group, n represents 1 or 2, $R^1$, $R^2$, $R^4$ and $R^5$ each represent an aryl group, an alkyl group, an alkoxy group, an aryloxy group, a hydroxyl group, an amino group, a cyano group, a carboxyl group, an amide group, an ester, an alkylcarbonyl, an alkylsulfo- or dialkylsulfonyl group or a hydrogen atom. $R^6$ and $R^7$ each represent a hydrogen atom, an alkyl group such as a methyl group and an ethyl group, or a cyano group. $R^{16}$ represents a phenyl group, a halogen atom or an alkyl-substituted phenyl group. $R^{15}$ represents an amino group or an organic primary or secondary amine.

Next, the oil-soluble brightening agent used in this invention may include the following compounds (1) to (26). Needless to say, this invention is by no means limited to these specific compounds.

(1)

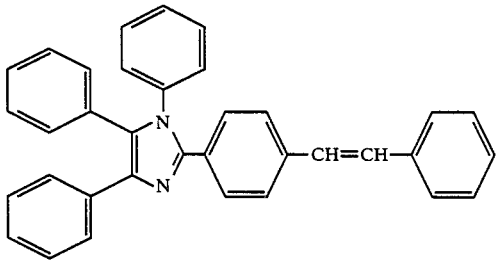

-continued
(2)
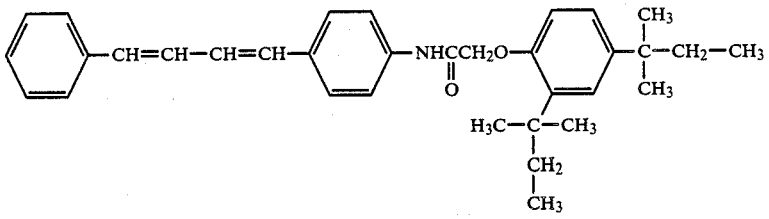
(3)
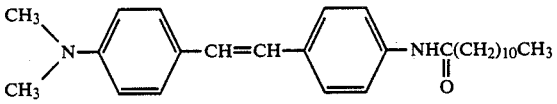
(4)
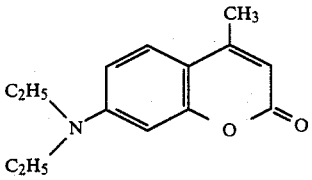
(5)
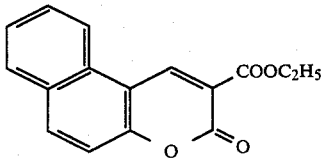
(6)
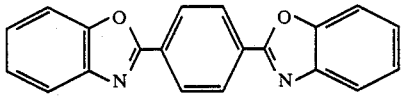
(7)
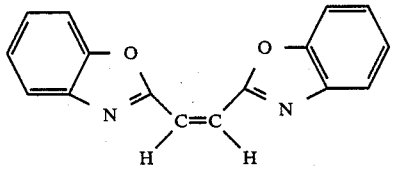
(8)
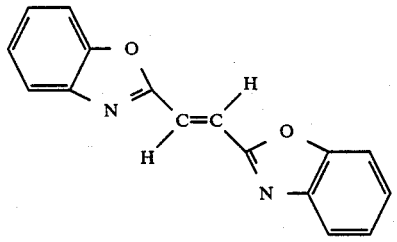
(9)
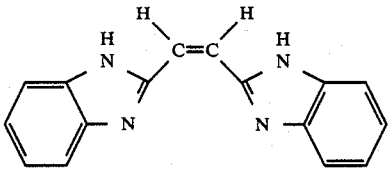
(10)
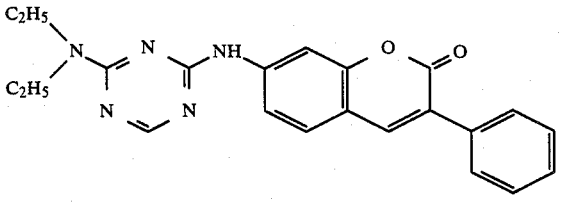

-continued
(11)
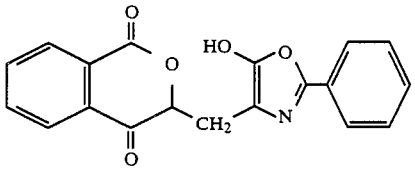
(12)
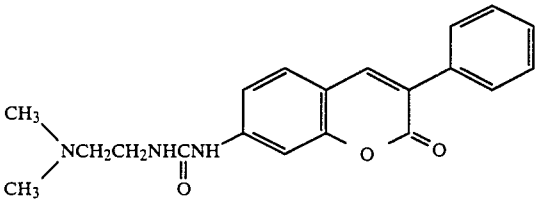
(13)
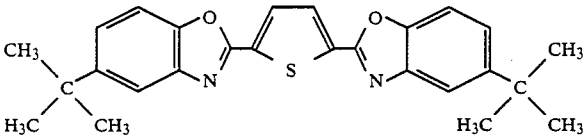
(14)
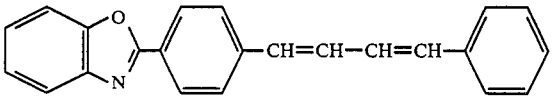
(15)
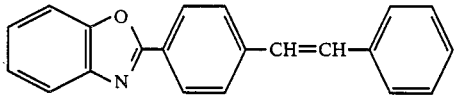
(16)
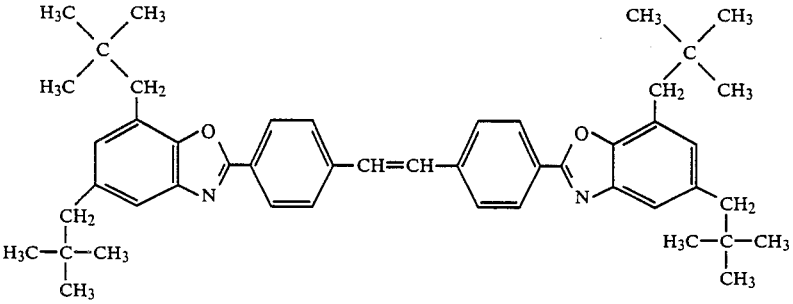
(17)
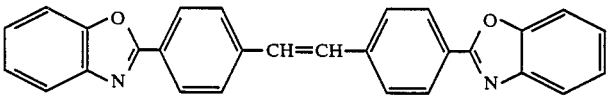
(18)
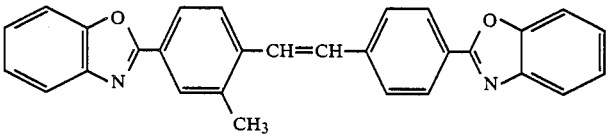
(19)
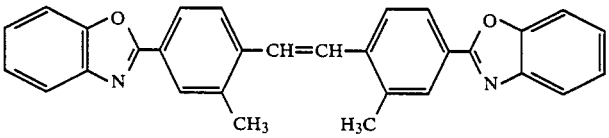
(20)
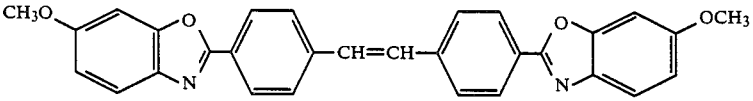

-continued (21)

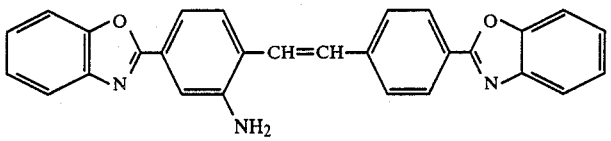

(22)

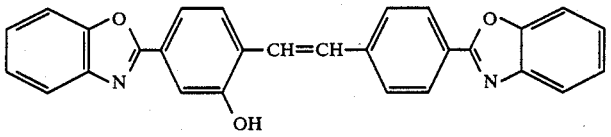

(23)

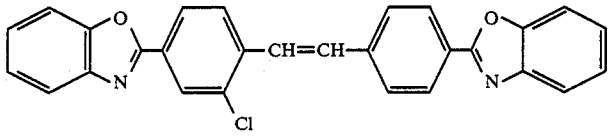

(24)

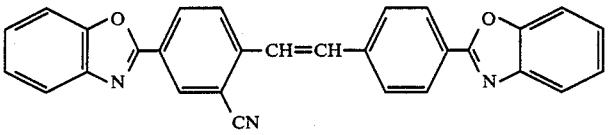

(25)

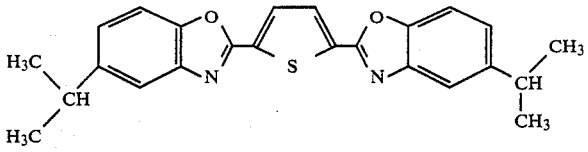

(26)

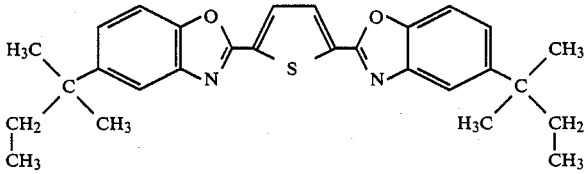

The above specific compounds (1) to (26) may be used alone or as a mix of two or more kinds The brightening agent may preferably be used by adding it so as to be contained in an amount of 1 to 200 $mg/m^2$ in finished photographic paper, and may be most preferably used in the range of from 5 to 50 $mg/m^2$.

The emulsion dispersion of the brightening agent used in this invention may be added in any of the layers in the photographic elements on the support, but, from a viewpoint of preventing the so-called blooming, preferably be added in a silver halide emulsion layer or a layer closer to the support (i.e., a hydrophilic colloid layer such as an intermediate layer).

As methods for adding the oil-soluble brightening agent, there may include, for example, the same methods as conventionally used in respect of oil-soluble couplers, oil-soluble ultraviolet absorbents, etc., namely, a method in which it is dissolved in a high-boiling organic solvent optionally together with a low-boiling solvent, mixed with an aqueous gelatin solution containing a surface active agent, and added as an emulsion dispersion prepared by means of an emulsifying apparatus such as a colloid mill, a homogenizer, an ultrasonic dispersing apparatus, etc.

The high-boiling solvent mentioned in the present specification refers to a solvent having a boiling point exceeding 200° C. The high-boiling solvent that can be used in this invention may include carbonic acid esters, phosphoric acid esters, carboxylic acid amides, ethers, substituted hydrocarbons, etc., specifically including di-n-butyl phthalate, di-iso-octyl phthalate, dimethoxyethyl phthalate, di-n-butyl adipate, diisooctyl azeate, tri-n-butyl citrate, butyl laurate, di-n-sebacate, tricrezyl phosphate, tri-n-butyl phosphate, triisooctyl phosphate, N,N-diethylcaprylic acid amide, N,N-dimethylpalmitic acid amide, n-butyl-pentadecyl phenyl ether, ethyl-2,4-tert-butyl phenyl ether, succinate, maleate, paraffin chloride, etc., which can be used alone or in combination of two or more kinds. The low-boiling solvent may include ethyl acetate, butyl acetate, cyclohexane, propylene carbonate, methanol, sec-butyl alcohol, tetrahydrofuran, dimethylformamide, benzene, chloroform, acetone, methyl ethyl ketone, diethyl sulfoxide, methyl cellosolve, etc., which can be optionally used alone or in combination of two or more kinds. As the surface active agent, there can be used anionic active agents, nonanionic active agents and a combination of these, and can be used, for example, alkylbenzene sulfonates, dialkyl sulfosuccinates, saponin, etc. As the gelatin, there can be used, alone or in combination of two or more kinds, alkali method gelatin, acidic method gelatin, modified gelatin (for example, the modified gelatin described in Japanese Patent Publications No. 4854/1963 and No. 12237/1965, U.S. Pat. No. 2,525,753, etc.). If necessary, there can be also used naturally occurring or synthetic binders (for example, polyvinyl alcohol, polyvinyl pyrrolidone, etc.).

As other methods for adding the oil-soluble brightening agent, available are a method in which the oil-soluble brightening agent is beforehand dissolved in a monomer, followed by polymerization to make a latex dispersion, and a method in which a hydrophobic polymer latex is impregnated with the brightening agent by use of an auxiliary solvent so that the oil-soluble brightening agent is added as a latex dispersion. These methods are disclosed, for example, in Japanese Unexamined Patent Publication No. 126732/1975, Japanese Patent Publication No. 47043/1976, U.S. Pat. No. 3,418,127, No. 3,359,102, No. 3,558,316 and No. 3,788,854, etc.

As the organic desensitizer, at least one of compounds represented by formula (I), (II), (III), (IV) or (V) may be contained and they are advantageously used as an organic desensitizer. They are excellent in imparting of high sensitivity and high brightening effect. In the photographic paper of this invention, it is sufficient for the paper to contain at least one kind of compounds selected optionally from the group consisting of compounds represented by formula (I), (II), (III), (IV) or (V). In this case, they may be one kind or two or more kinds of compounds represented by any one of the formulae, or alternatively two or more kinds of compounds represented by two or more of the formulae. In case where two or more kinds are used, any combination may be employed.

Specific examples of compounds represented by formula (I), (II), (III), (IV) or (V) will be given below, but this invention is by no means limited to these specific compounds.

(I-1)

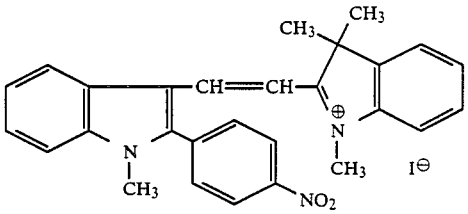

(I-2)

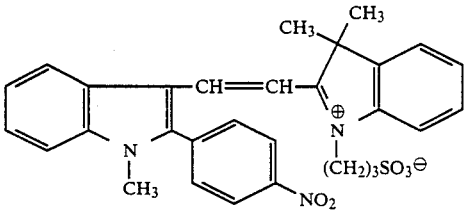

(I-3)

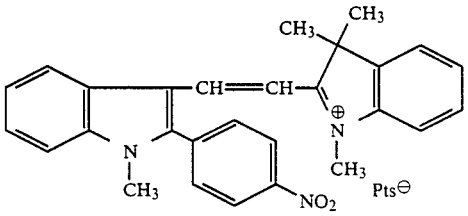

(Pts⊖ represents p-toluenesulfonic acid ion. The same applies in the description hereinafter)

(I-4)

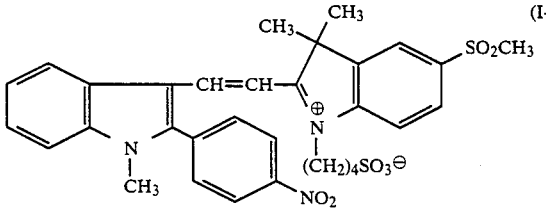

(I-5)

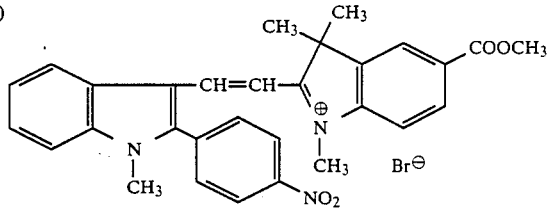

(I-6)

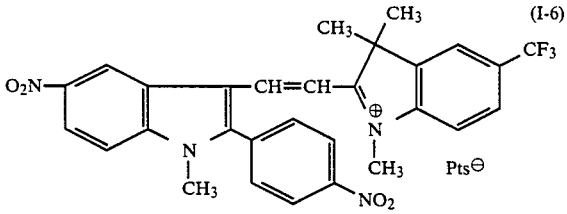

(I-7)

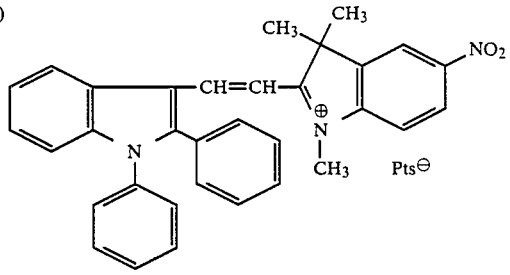

(I-8)

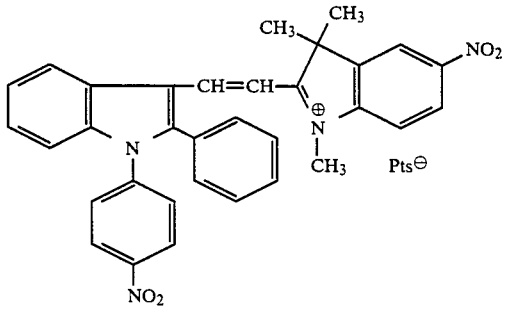

(I-9)

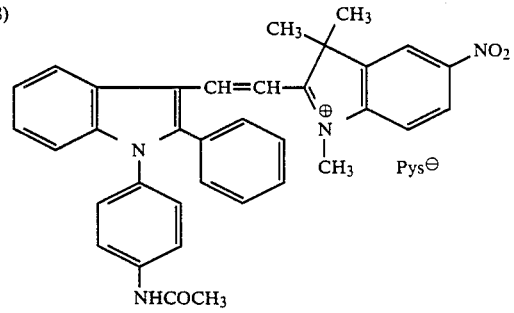

-continued
(II-1)
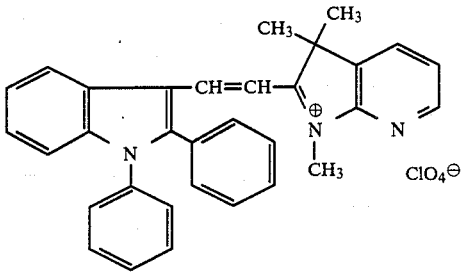
(II-2)
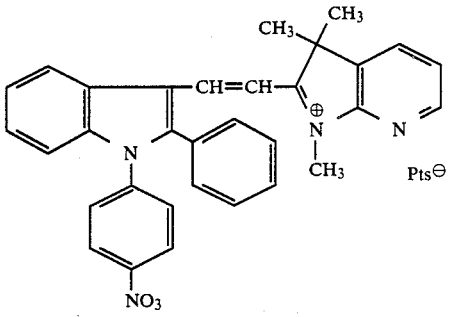
(II-3)
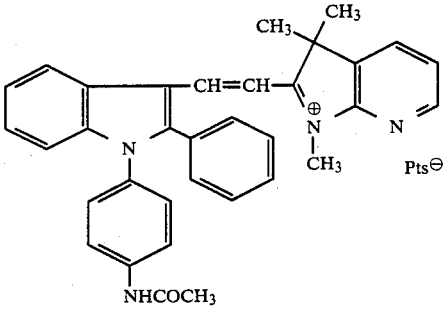
(III-1)
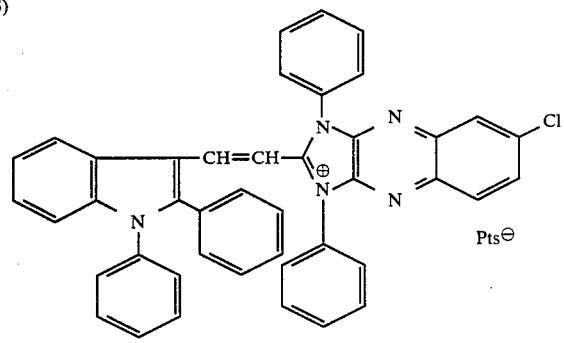
(III-2)
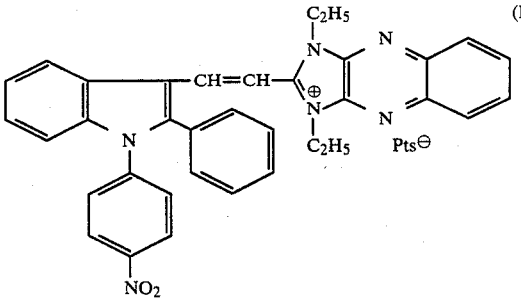
(III-3)
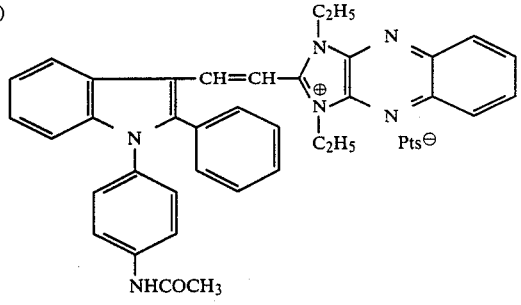
(III-4)
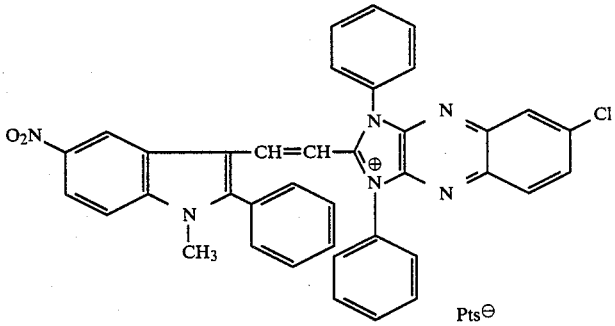
(III-5)
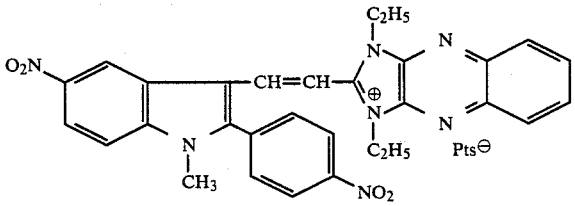

-continued (III-6)

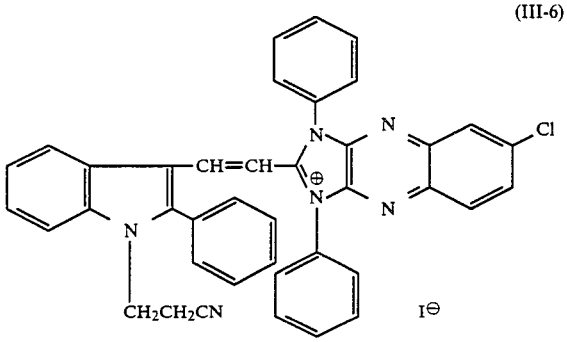

(IV-1)

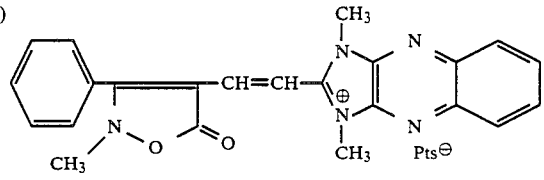

(IV-2)

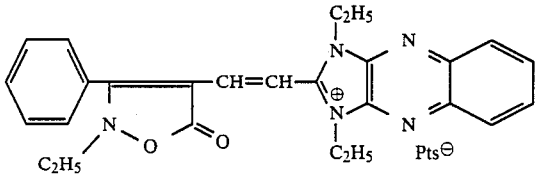

(V-1)

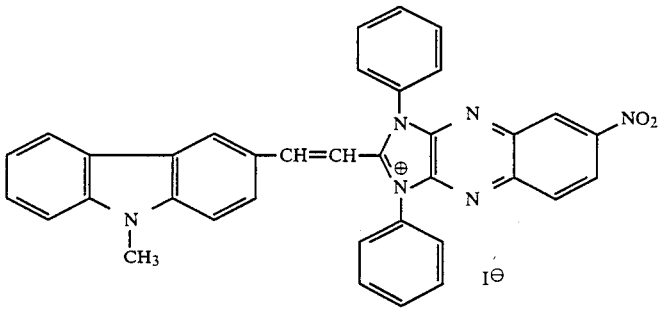

(V-2)

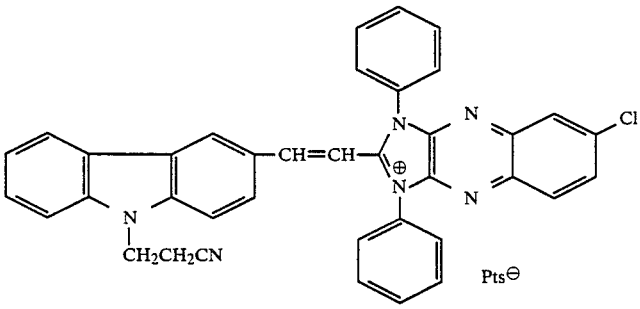

(V-3)

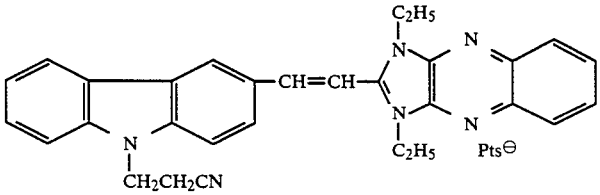

These organic desensitizers may be added in an amount of $10^{-4}$ to $10^{-2}$ mol per mol of silver halide, to a silver halide after desalting. The above organic desensitizers may be used alone or as a mix of two or more kinds.

As a method for preparing the organic desensitizer of this invention, there may be mentioned methods described in U.S. Pat. No. 3,567,456, No. 3,582,343 and No. 3,598,596 for the compounds represented by formula (I), (II) or (III), methods described in U.S. Pat. No. 3,539,349 for the compounds represented by formula (IV) and methods described in U.S. Pat. No. 3,431,111 and No. 3,492,123 for the compounds represented by formula (V).

The reduction fogging agent used for imparting fog in this invention may include, for example, formalin, hydrazine, polyamine (for example, triethylenetetramine, tetraethylenepentamine, etc.), thiourea dioxide, tetrahydroxymethylphosphonium chloride, amine borane, boron hydrides, stannous chloride, etc., which generally may be used in the range of from $10^{-7}$ to $10^{-3}$ mol per mol of silver halide. These reduction fogging agents may be used alone or may be used as a mix of two or more kinds.

The water-soluble gold compound may include, for example, potassium chloroaurate, chloroauric acid, potassium gold cyanide, potassium gold thiocyanate, sodium gold thiomaleate, gold thioglycose, etc., which generally may be used in the range of from $10^{-6}$ to $10^{-4}$ mole per mol of silver halide.

The silver halide emulsion used in this invention may have any grain size, any crystal habit and silver halide composition. However, useful as a light-sensitive material are those having a grain size of about 0.1 μm to about 1 μm as being preferable in view of graininess or sharpness. In the case of silver iodobromide, it preferably comprises not more than 5 mol %, more preferably not more than 3 mol %, of silver iodide as being practically advantageous because of smallness in the development restraint property. These silver halide emulsions can be prepared by various processes. For example, there can be used a process in which a soluble gold complex salt of group VIII is contained as described in U.S. Pat. No. 2,717,833, Japanese Patent Publication No. 4125/1968, British Pat. No. 1,186,717, etc.; a process for preparing an ammoniacal emulsion as described in U.S. Pat. No. 2,184,013; a process for preparing a monodispersed emulsion as described in U.S. Pat. No. 3,501,305; a process for preparing a heterodispersed emulsion as described in Japanese Unexamined Patent Publication No. 43627/1974; a process for preparing a regular grain emulsion as described in U.S. Pat. No. 3,501,306; a process for preparing a covered grain emulsion as described in U.S. Pat. No. 3,367,785, British Pat. No. 1,229,868 and No. 1,186,718, etc.; and a process for preparing an internal latent image type emulsion as described in U.S. Pat. No. 2,592,250.

In the silver halide photographic emulsion for direct positives used in this invention, other additives for photography can be used. As a stabilizer, there may be contained triazoles, azaindenes, quaternary benzothiazolium compounds, mercapto compounds, or water soluble inorganic salts of cadmium, cobalt, nickel, manganese, gold, thallium, zinc, etc. As a hardening agent, there may be also contained, for example, aldehides such as formalin, glyoxal and mucochloric acid, s-triazines, epoxy compound, aziridines, vinyl sulfonic acid, etc.; as a coating auxiliary, for example, saponin, sodium polyalkylene sulfonate, lauryl or oleyl monoethers of polyethylene glycol, amylated alkyl taurine, fluorine-containing compounds, etc.; and, as a sensitizer, for example, polyalkylene oxide and derivatives thereof. It is also possible to contain color couplers. Besides, if necessary, an anticeptic, a matte agent, an antistatic agent, a developing agent, etc. can be also contained.

As the support, there can be used baryta paper, polyolefin-coated paper, or synthetic paper such as polypropylene synthetic paper. In such a support, a variety of inorganic white pigments, inorganic color pigments, dispersants, brightening agents, antistatic agents, antioxidants, stabilizers, etc. can be added. Also, the surface of the support may be subjected to surface-activating treatment such as corona discharge treatment and flame treatment, and there can be optionally provided with a subbing layer.

The light-sensitive silver halide photographic material for direct positives of this invention can be applied in various uses. For example, various light-sensitive photographic materials for printing such as those for use in duplicating, reproduction and offset master; light-sensitive materials for special photography such as X-ray photography, flash light photography and electron ray photography; or various direct positive light-sensitive silver halide photographic materials used in general copying, micro copying, direct positive type color process, a quick stabilized process, a diffusion transfer process, a color diffusion transfer process, combined developing and fixing, etc. It is possible to process these light-sensitive materials with use of various developing solutions depending on the uses. For example, they can be processed with use of a general black-and-white developing solution (for example, a phenidone/-hydroquinone developing solution, a Metol/hydroquinone developing solution, or a tanning developing solution), a color developing solution (for example, a phenylenediamine type developing solution), etc. After the developing, usual fixing, stabilizing or bleaching may be carried out.

This invention will be described in detail by Examples, but the working embodiments of this invention are by no means limited to these.

EXAMPLE 1

Preparation of emulsion coating solutions

In an aqueous gelatin solution kept at 60° C., an aqueous solution of silver nitrate and an aqueous solution comprising potassium bromide and potassium iodide were simultaneously added over a period of 120 minutes while controlling the addition rate so as to increase with lapse of time. The pH in the course of the precipitation was kept to about 2 with use of nitric acid, and the pAg was kept to 7.0. After the precipitation was completed, the pH was adjusted to about 5.5 with use of an aqueous solution of sodium carbonate, and water-soluble salts were removed according to a usual coagulation method, followed by addition of gelatin to complete the preparation. There was obtained a silver iodobromide emulsion containing 2 mol % of silver iodide and comprising highly monodispersed regular cubic grains having an average grain size of 0.27 μm.

The above emulsion was adjusted to have the pH of 6.8 with use of an aqueous solution of sodium carbonate, and while keeping the pAg to 6.8, ripened for 60 minutes at 70° C. with the pAg of 6.8 and with the addition of 0.12 mg of thiourea dioxide per 1 mol of silver halide, and then ripened for 60 minutes at 70° C. with the addition of 0.50 mg of chloroauric acid per 1 mol of silver halide, to effect reduction fogging and gold fogging.

The emulsion to which fog was imparted was adjusted to pAg 9.2 by adding potassium bromide, subsequently the organic desensitizer represented by structural formula (I-4) or (IV-1) shown below was added thereto in an amount of 600 mg per 1 mol of silver halide, and the emulsion was further adjusted to pH 5.3 with use of citric acid.

(I-4)

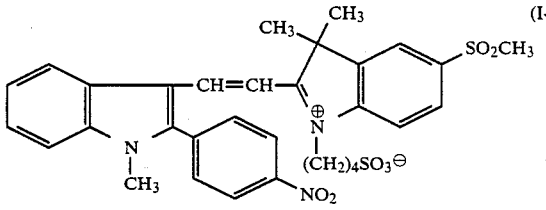

-continued

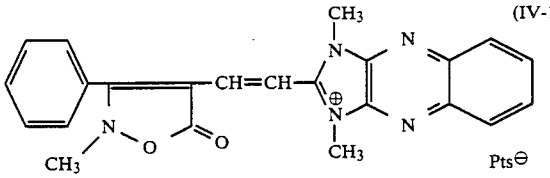

(IV-1)

Next, oil-soluble brightening agent (4), (10) or (13) according to this invention as shown in Table 1 was added as the emulsion dispersion or latex dispersion in an amount of 40 mg/m$^2$, and further added were 0.2 g/m$^2$ of diethylene glycol as a wetting agent, 40 mg/m$^2$ of sodium 1-decyl-2-(3-isopentyl)succinate-2-sulfonate as a coating auxiliary, 60 mg/m$^2$ of a styrene/maleic anhydride copolymer as a thickening agent and 10 mg of formalin per 1 g of gelatin as a hardening agent to prepare a coating solution of the silver halide emulsion for direct positives. For comparison, prepared were an emulsion coating solution to which the water-soluble brightening agent of the structural formula (27) or (28) shown below was added in the amount as shown in Table 1 and an emulsion coating solution to which polyvinyl pyrrolidone was further added simultaneously in an amount of 80 mg/m$^2$.

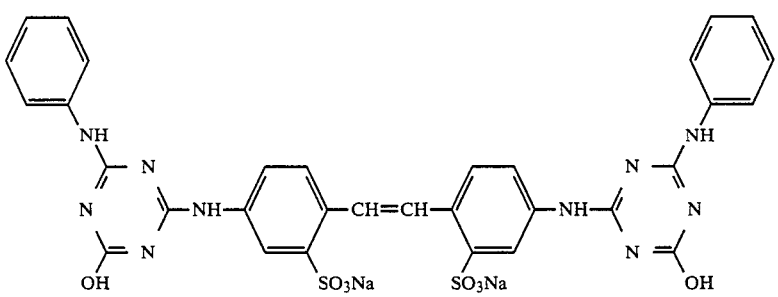

(27)

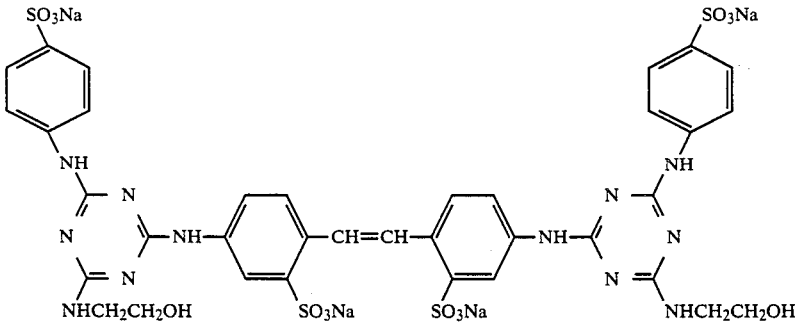

(28)

Preparation of emulsion dispersion of brightening agent

After 1 g of exemplary compound (4), (10) or (13) as an oil-soluble brightening agent, 20 g of di-2-ethylhexylphthalate as a high-boiling organic solvent and 20 ml of ethyl acetate as a low-boiling organic solvent were mixed and dissolved, the resulting solution was added in 250 ml of a 12% aqueous gelatin solution containing 0.5 g of sodium tripropylnaphthalenesulfonate, and dispersed by emulsification at about 60° C. with use of an ultrasonic dispersing machine.

Preparation of latex dispersion of brightening agent

In 30 g of ethyl acrylate, 1 g of oil-soluble brightening agent (13) was dissolved, and 10 g of sodium p-nonylphenoxy-pentaethylene glycoxybutanesulfonate was added to the solution, which was then mixed with 120 ml of water and stirred. The mixture was heated to 60° C. and thereafter 30 g of sodium persulfate and 1 g of sodium hydrogensulfite were added thereto, followed by polymerization with stirring for 4 hours while keeping the temperature at 60° C. After cooling, filtration was carried out with use of muslin to obtain a latex dispersion.

Preparation of coating solution for protective layer

In an aqueous gelatin solution adjusted to pH 5.3 with use of an aqueous citric acid solution, potassium bromide was added in an amount of 1.2 g per 100 g of gelatin, and further added were 30 mg/m$^2$ of silica gel having an average particle size of about 3 μm as a surface-matting agent, 30 mg/m$^2$ of a 2-sulfonate succinic acid bis(2-ethylhexyl) ester sodium salt as a coating auxiliary, 20 mg/m$^2$ of the compound of (F) shown below as a fluorine-containing surface active agent, 100 mg/m$^2$ of a styrene/maleic anhydride copolymer as a thickening agent and 10 mg of formalin per 1 g of gelatin as a hardening agent to prepare a coating solution for a protective layer.

(F)

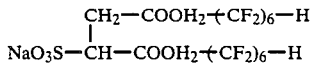

Production of coated sample

The above emulsion coating solution and coating solution for protective layer were coated to give overlapped layers on polyethylene-coated paper of 150 μm thick having a subbing layer, to produce a sample. The coating amount of silver was 1.4 g/m$^2$, and the coating amount of gelatin was 2.0 g/m$^2$ in the emulsion layer and 1.0 g/m$^2$ in the protective layer.

Evaluation of photographic performance and whiteness

After the coated sample was exposed to light through an wedge, development processing was carried out using as an automatic processor Sakura Automatic Processor GR-14 (produced by Konishiroku Photo Industry Co., Ltd.) and, as a developing solution and a fixing solution, the solutions formulated as shown below, to evaluate a photographic performance. Conditions for development were such that developing was carried out for 20 seconds at 38° C.; fixing, for 20 seconds at 35° C.; washing, for 20 seconds at room temperature; and drying, at about 45° C.

Formulation of developing solution

| | |
|---|---|
| Pure water (ion-exchanged water) | about 800 ml |
| Potassium sulfite | 60 g |
| Disodium ethylenediaminetetraacetate | 2 g |
| Potassium hydroxide | 10.5 g |
| 5-Methylbenzotriazole | 300 mg |
| Diethylene glycol | 25 g |
| 1-Phenyl-4,4-dimethyl-3-pyrazolidinone | 300 mg |
| 1-Phenyl-5-mercaptotetrazole | 60 mg |
| Potassium bromide | 3.5 g |
| Hydroquinone | 20 g |
| Potassium carbonate | 15 g |
| Made up to 1,000 ml by adding water (ion-exchanged water). | |

The development solution had the pH of about 10.6.

Formulation of fixing solution (Composition A)

| | |
|---|---|
| Ammonium thiosulfate (a 72.5% w/v aqueous solution) | 240 ml |
| Sodium sulfite | 17 g |
| Sodium acetate trihydrate | 6.5 g |
| Boric acid | 6 g |
| Sodium citrate dihydrate | 2 g |
| Acetic acid (a 90% w/w aqueous solution) | 13.6 ml |

(Composition B)

| | |
|---|---|
| Pure water (ion-exchanged water) | 17 ml |
| Sulfuric acid (a 50% w/w aqueous solution) | 4.7 g |
| Aluminum sulfate (an aqueous solution having aluminum content of 8.1% w/w in terms of $Al_2O_3$) | 26.5 g |

When using the fixing solution, it was used by dissolving the solutions of the above composition A and composition B in this order in 500 ml of water to make up the whole to 1 lit.

This fixing solution had the pH of about 4.3.

Results obtained are shown in Table 1. The sensitivity shown in Table 1 is expressed by a relative value of a reciprocal of the exposure amount necessary for giving the density of 1.0.

TABLE 1

| Sample No. | Organic desensitizer Type | Water-souble brightening agent Compound | Water-souble brightening agent Amount | Polyvinyl pyrrolidone Amount | Oil-soluble brightening agent Compound | Oil-soluble brightening agent Amount | Method for dispersion of oil-soluble brightening agent | Sensitivity | Whiteness |
|---|---|---|---|---|---|---|---|---|---|
| Comparative Ex. 1 | (I) | — | — | — | — | — | — | 100 | Strongly yellowish |
| Comparative Ex. 2 | (I) | (27) | 20 mg/m$^2$ | — | — | — | — | 50 | Slightly yellow |
| Comparative Ex. 3 | (I) | (27) | 40 mg/m$^2$ | — | — | — | — | 30 | White White |
| Comparative Ex. 4 | (I) | (27) | 40 mg/m$^2$ | 80 mg/m$^2$ | — | — | — | 70 | White White |
| Invention Ex. 5 | (I) | — | — | — | (4) | 40 mg/m$^2$ | Emulsion dispersion | 100 | White |
| Invention Ex. 6 | (I) | — | — | — | (10) | 40 mg/m$^2$ | Emulsion dispersion | 100 | White |
| Comparative Ex. 7 | (II) | — | — | — | — | — | — | 120 | Strongly yellowish |
| Comparative Ex. 8 | (II) | (28) | 20 mg/m$^2$ | — | — | — | — | 80 | Slightly yellow |
| Comparative Ex. 9 | (II) | (28) | 40 mg/m$^2$ | — | — | — | — | 50 | White |
| Comparative Ex. 10 | (II) | (28) | 40 mg/m$^2$ | 80 mg/m$^2$ | — | — | — | 90 | White |
| Invention Ex, 11 | (II) | — | — | — | (13) | 40 mg/m$^2$ | Emulsion dispersion | 100 | White |
| Invention Ex. 12 | (II) | — | — | — | (13) | 40 mg/m$^2$ | Latex dispersion | 120 | White |

Evaluation on the whiteness was visually made after a sample to which uniform exposure was given was subjected to development processing under the same conditions as those for the evaluation on the photographic performance. Results obtained are shown in Table 1. As will be clear from the results shown in Table 1, samples 5, 6, 11 and 12 satisfying the requirements of this invention show no decrease in the sensitivity and at the same time show good whiteness.

EXAMPLE 2

Preparation of emulsion coating solutions

In 1 liter of a 1% aqueous gelatin solution kept at 65° C., 220 ml of a 3% aqueous solution of silver nitrate and 220 ml of an aqueous solution comprising 98 mole % of potassium bromide and 2 mole % of potassium iodide relative to the silver nitrate were simultaneously added over a period of 30 minutes while controlling the addition rate so as to increase with lapse of time. Subsequently, 280 ml of a 40% aqueous solution of silver nitrate and 280 ml of an aqueous solution comprising 98 mole % of potassium bromide and 2 mole % of potasium iodide relative to the silver nitrate were simultaneously added thereto over a period of 100 minutes while controlling the addition rate so as to increase with lapse of time. The pH in the course of the precipitation was kept to about 2 with use of nitric acid, and the pAg was kept to about 7.5 with use of potassium bromide.

After the precipitation was completed, the pH was adjusted to about 5.5 with use of an aqueous solution of sodium carbonate, and water-soluble salts were removed according to a usual coagulation method, followed by addition of 15 g of gelatin to complete the preparation. There was obtained a silver iodobromide emulsion containing 2 mol % of silver iodide and comprising highly monodispersed regular cubic grains having an average grain size of 0.27 μm.

The above emulsion was adjusted to have the pH of 6.8 with use of an aqueous solution of sodium carbonate, and ripened for 60 minutes at 70° C. with the pAg of 6.8 and with the addition of 0.12 mg of thiourea dioxide per 1 mol of silver halide, and then ripened for 60 minutes at 70° C. with the addition of 0.50 mg of chloroauric acid per 1 mol of silver halide, to effect reduction fogging and gold fogging.

The emulsion to which fog was imparted was adjusted to pAg 9.2 by adding potassium bromide, subsequently the compound (I-14), (II-1), (III-3), (IV-1) or (V-1) according to this invention or compound represented by structural formula (A), (B), (C), (D) or (E) having no relation with this invention shown below was added as an organic desensitizer in an amount of 600 mg per 1 mol of silver halide, and the emulsion was further adjusted to pH 5.3 with use of citric acid.

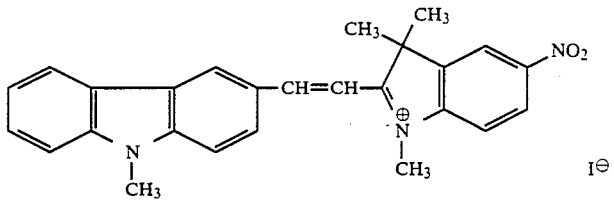

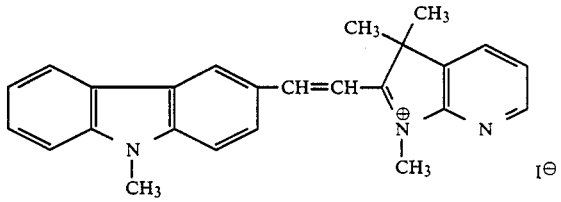

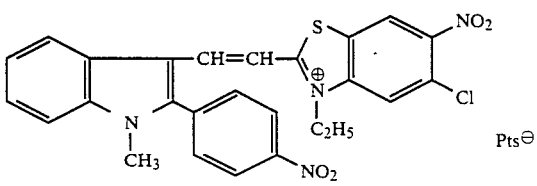

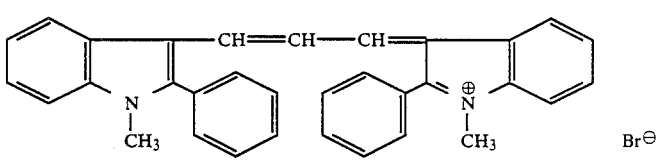

or

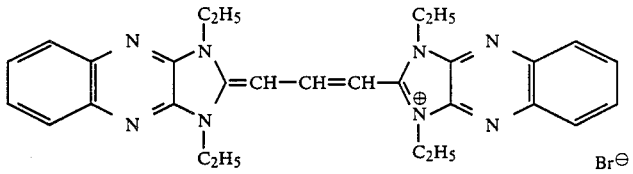

Next, oil-soluble brightening agent (4) according to this invention as shown in Table 2 was added as the emulsion dispersion in an amount of 40 mg/m$^2$, and further added were 0.2 g/m$^2$ of diethylene glycol as a wetting agent, 40 mg/m$^2$ of sodium 1-decyl-2-(3-isopentyl)succinate-2-sulfonate as a coating auxiliary, 60 mg/m$^2$ of a styrene/maleic anhydride copolymer as a thickening agent and 10 mg of formalin per 1 g of gelatin as a hardening agent to prepare a coating solution of the silver halide emulsion for direct positives. For comparison, prepared were an emulsion coating solution to which the water-soluble brightening agent of the structural formula (X) shown below was added in an amount of 40 mg/m$^2$ and an emulsion coating solution to which polyvinyl pyrrolidone was added in an amount of 80 mg/m$^2$ in addition to the above water-soluble brightening agent.

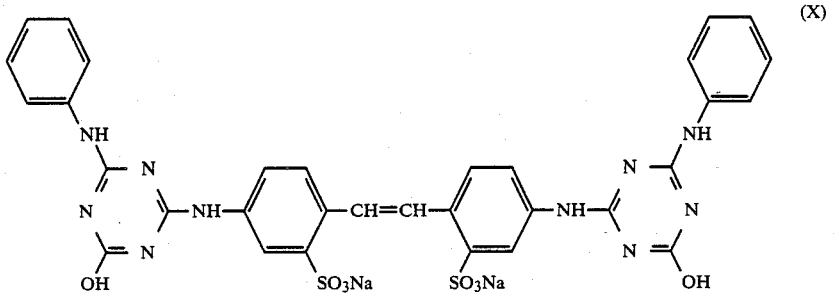

Preparation of emulsion dispersion of brightening agent

After 1 g of exemplary compound (4) as an oil-soluble brightening agent, 20 g of di-2-ethylhexylphthalate as a high-boiling organic solvent and 20 ml of ethyl acetate as a low-boiling organic solvent were mixed and dissolved, the resulting solution was added in 250 ml of a 12% aqueous gelatin solution containing 0.5 g of sodium tripropylnaphthalenesulfonate, and dispersed by emulsification at about 60° C. with use of an ultrasonic dispersing machine.

Preparation of coating solution for protective layer

A coating solution for a protective layer was prepared in the same manner as in Example 1.

Production of coated sample

A coated sample was prepared in the same manner as in Example 1.

Evaluation of photographic performance and brightness

The coated sample was subjected to the same processing as in Example 1.

The sensitivity is expressed by a relative value of a reciprocal of the exposure amount necessary for giving the density of 1.0.

Evaluation of the intensity of brightness was made by measuring reflective density of unexposured portion of processed sample with use of a color analyzer 607 type (produced by Hitachi production Co. Ltd) using a xenon lamp as a light source. Relative intensity of brightness is shown as a relative value of decrease in the reflective density at 440 nm, caused by addition of the brightening agent.

Result of the evaluation

Results obtained are shown in Table 2. As will be clear from the results shown in Table 2, samples 13 to 17 according to this invention are found to have a high sensitivity because of a high relative sensitivity of 80 to 120 and to be excellent in brightening effect because of a high relative intensity of brightness of 97 to 102. On the other hand, samples 18 and 20 to 30 which are out of this invention are found to have a poor sensitivity because of a low relative sensitivity of 20 to 90 and to be poor in brightening effect because of a low relative intensity of brightness of 30 to 85. Further, sample 19 which is out of this invetion is found to be good in sensitivity because of a high relative sensitivity of 100, however, to be poor in the brightening effect because of a low relative intensity of brightness of 82. Accordingly, any of samples which are out of this invention are found not to be used practically.

TABLE 2

| Sample No. | Brightening agent | Polyvinyl pyrrolidone | Organic desensitizer | Relative sensitivity | Relative intensity of brightness |
|---|---|---|---|---|---|
| Invention Ex. 13 | Oil-souble (4) | — | (I - 4) | 100 | 100 |
| Invention Ex. 14 | Oil-soluble (4) | — | (II - 1) | 100 | 102 |
| Invention Ex. 15 | Oil-soluble (4) | — | (III - 3) | 120 | 100 |
| Invention Ex. 16 | Oil-soluble (4) | — | (IV - 1) | 120 | 98 |
| Invention Ex. 17 | Oil-soluble (4) | — | (V - 1) | 80 | 97 |
| Comparative Ex. 18 | Oil-soluble (4) | — | (A) | 80 | 80 |
| Comparative Ex. 19 | Oil-soluble (4) | — | (B) | 100 | 82 |
| Comparative Ex. 20 | Oil-soluble (4) | — | (C) | 50 | 76 |
| Comparative Ex. 21 | Oil-soluble (4) | — | (D) | 60 | 85 |
| Comparative Ex. 22 | Oil-soluble (4) | — | (E) | 40 | 83 |
| Comparative Ex. 23 | Water-soluble (X) | — | (I - 4) | 30 | 30 |
| Comparative Ex. 24 | Water-soluble (X) | present | (I - 4) | 70 | 55 |
| Comparative Ex. 25 | Water-soluble (X) | — | (III - 3) | 40 | 30 |
| Comparative Ex. 26 | Water-soluble (X) | present | (III - 3) | 90 | 50 |
| Comparative Ex. 27 | Water-soluble (X) | — | (A) | 25 | 30 |
| Comparative Ex. 28 | Water-soluble (X) | present | (A) | 60 | 52 |
| Comparative Ex. 29 | Water-soluble (X) | — | (C) | 20 | 30 |
| Comparative Ex. 30 | Water-soluble (X) | present | (C) | 40 | 50 |

EXAMPLE 3

Samples were prepared in the same manner as in Example 2 except that, as an organic desensitizer, the compound (I-7), (II-3), (III-6), (IV-2) or (V-3) according to this invention was used in place of (I-4), (II-1), (III-3), (IV-1) or (V-1), or a compound represnted by structural formula (J), (K), (L), (M) or (N) having no ralation with this invention shown below was used in place of the compound represented by structural formula (A), (B), (C), (D) or (E), and the oil-soluble brightening agent (13) according to this invention was further added in a form of emulsion dispersion prepared according to the method described below, or a compound represented by structural formula (Y) shown below was added as a comparative water-soluble brightening agent. The thus prepared samples were subjected to evaluation of photographic performance and the intensity of brightness in the same manner as in Example 2.

Preparation of emulsion dispersion of brightening agent

After 1 g of exemplary compound (13) as an oil-soluble brightening agent, 20 g of tricrezyl phosphate as a high-boiling organic solvent and 20 ml of ethyl acetate as a low-boiling organic solvent were mixed and dis-

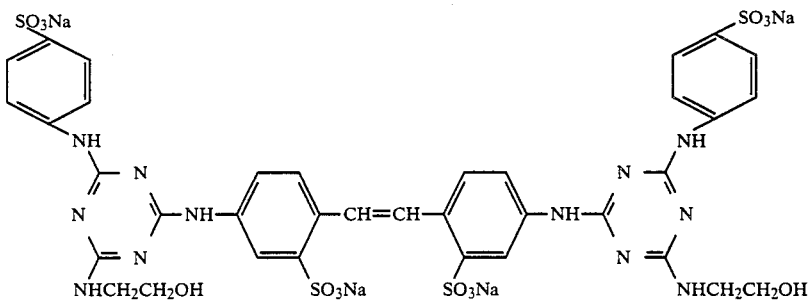

(Y)

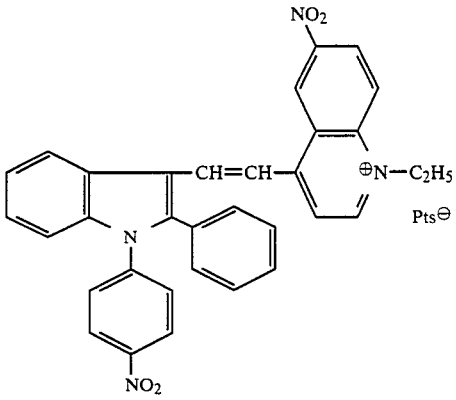

(J)

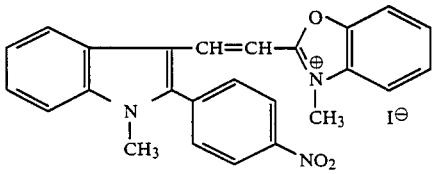

(K)

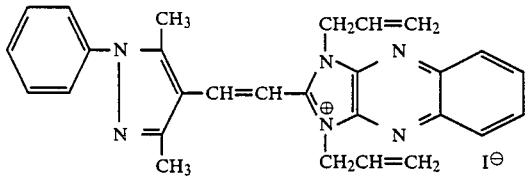

(L)

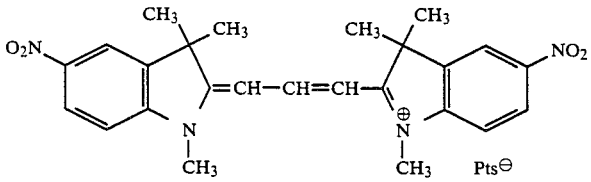

(M)

or

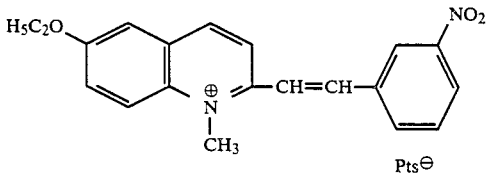

(N)

solved, the resulting solution was added in 250 ml of a 12% aqueous gelatin solution containing 0.5 g of sodium tripropylnaphthalenesulfonate, and dispersed by emulsification at about 60° C. with use of an ultrasonic dispersing machine. After cooling the thus prepared emulsion dispersion to 40° C., was added 40 ml of latex liquor containing, as a solid component, polyethylacrylate in an amount of 50%, to prepare brightening agent emulsion dispersion.

Evaluation of photographic performance and intensity of brightness

Evaluation was made in the same manner as in Example 2.

Result of the evaluation

Results obtained are shown in Table 3. As will be clear from the results shown in Table 3, samples 31 to 35 according to this invention are found to have high sensitivity because of high relative sensitivity of 90 to 120 and to be excellent in brightening effect because of a high relative intensity of brightness of 96 to 103. On the other hand, samples 36, 37 and 39 to 48 which are out of this invention are found to have poor sensitivity because of a low relative sensitivity of 25 to 80 and to be poor in brightening effect because of a low relative intensity of brightness of 35 to 85. Further, sample 38 which is out of this invention is found to be good in sensitivity because of a high relative sensitivity of 120, however, to be poor in the brightening effect because of a low relative intensity of brightness of 74. Accordingly, any of samples which are out of this invention are found not to be used practically.

TABLE 3

| Sample No. | Brightening agent | Polyvinyl pyrrolidone | Organic desensitizer | Relative sensitivity | Relative intensity of brightness |
|---|---|---|---|---|---|
| Invention Ex. 31 | Oil-soluble (13) | — | (I - 7) | 100 | 100 |
| Invention Ex. 32 | Oil-soluble (13) | — | (II - 3) | 100 | 100 |
| Invention Ex. 33 | Oil-soluble (13) | — | (II - 6) | 120 | 96 |
| Invention Ex. 34 | Oil-soluble (13) | — | (IV - 2) | 120 | 97 |
| Invention Ex. 35 | Oil-soluble (13) | — | (V - 3) | 90 | 103 |
| Comparative Ex. 36 | Oil-soluble (13) | — | (J) | 60 | 77 |
| Comparative Ex. 37 | Oil-soluble (13) | — | (K) | 40 | 82 |
| Comparative Ex. 38 | Oil-soluble (13) | — | (L) | 120 | 74 |
| Comparative Ex. 39 | Oil-soluble (13) | — | (M) | 50 | 80 |
| Comparative Ex. 40 | Oil-soluble (13) | — | (N) | 40 | 85 |
| Comparative Ex. 41 | Water-soluble (Y) | — | (II - 3) | 40 | 35 |
| Comparative Ex. 42 | Water-soluble (Y) | present | (II - 3) | 75 | 60 |
| Comparative Ex. 43 | Water-soluble (Y) | — | (IV - 2) | 50 | 35 |
| Comparative Ex. 44 | Water-soluble (Y) | present | (IV - 2) | 80 | 60 |
| Comparative Ex. 45 | Water-soluble (Y) | — | (J) | 25 | 35 |
| Comparative Ex. 46 | Water-soluble (Y) | present | (J) | 45 | 63 |
| Comparative Ex. 47 | Water-soluble (Y) | — | (L) | 50 | 35 |
| Comparative Ex. 48 | Water-soluble (Y) | present | (L) | 80 | 58 |

As described in the above, according to this invention, it is possible to obtain silver halide photographic paper for direct positives, having high sensitivity and high whiteness.

We claim:

1. A silver halide photographic paper for direct positives, comprising a support and a silver halide emulsion layer for direct positives, provided on the support and containing silver halide grains having been fogged in the presence of a reduction fogging agent and a water-soluble gold compound, wherein a photographic layer on the side on which said silver halide emulsion layer for direct positives is provided contains an emulsion dispersion or latex dispersion of an oil-soluble brightening agent, and simultaneously contains at least one of organic desensitizers represented by formula (I), (II), (III), (IV) or (V):

formula (I)

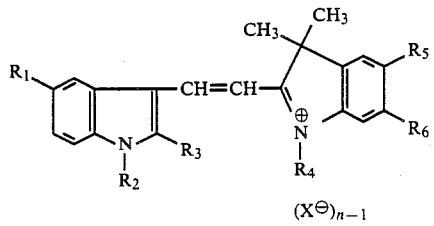

formula (II)

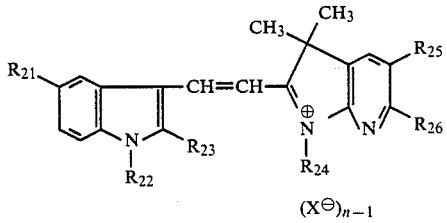

formula (III)

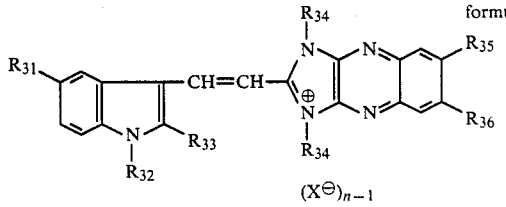

formula (IV)

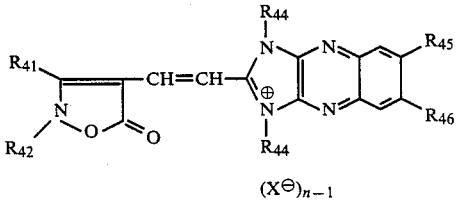

or

-continued formula (V)

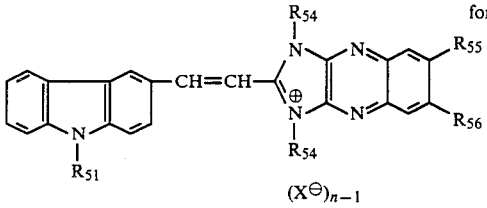

wherein $R^1$, $R^{21}$ and $R^{31}$ each represent a hydrogen atom, a halogen atom, an alkyl group, an alkoxy group, aryloxy group or a nitro group, $R^2$, $R^3$, $R^4$, $R^{22}$, $R^{23}$, $R^{24}$, $R^{32}$, $R^{33}$, $R^{34}$, $R^{44}$ and $R^{54}$ each represent an alkyl group, an alkenyl group, an aryl group or an aralkyl group, which may be unsubstituted or substituted, $R^5$, $R^6$, $R^{25}$, $R^{26}$, $R^{35}$, $R^{36}$,$R^{45}$, $R^{46}$, $R^{55}$ and $R^{56}$ each represent a hydrogen atom, a halogen atom, an alkyl group, an aryl group, a thienyl group, an alkoxy group, a hydoxy group, a cyano group, an alkylsulfonyl group, an alkoxycarbonyl group, a phenylsulfonyl group, a trifluoromethyl group, a trifluoromethylsulfonyl group or a nitro group, $R^{41}$ represents an aryl group, $R^{42}$ represents an alkyl group, $R^{51}$ represents an alkyl group which may be unsubstituted or substituted, $X^{\ominus}$ represents an anion and n represents 1 or 2 with proviso that in case where the compound forms an internal salt, n is 1 and said oil-soluble brightening agent being selected from the group consisting of:

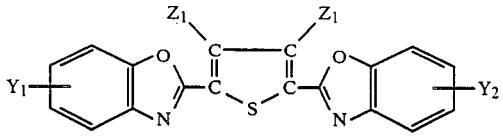

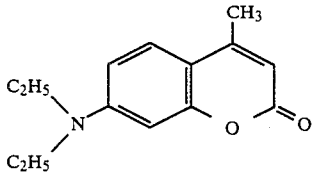

(4)

and

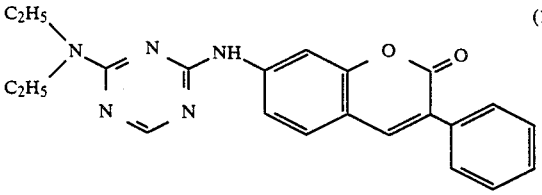

(10)

wherein $Y^1$ and $Y^2$ each represent an alkyl group, $Z^1$ a hydrogen atom or an alkyl group.

2. The photographic paper according to claim 1, wherein said oil-soluble brightening agent is selected from the group consisting of:

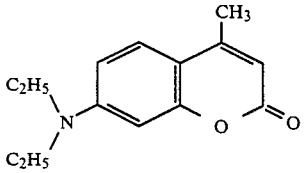

(4)

-continued

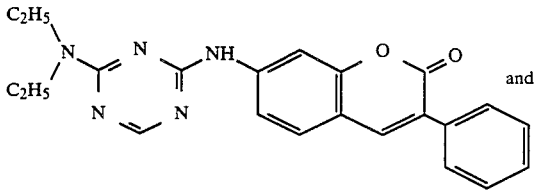

(10)

and

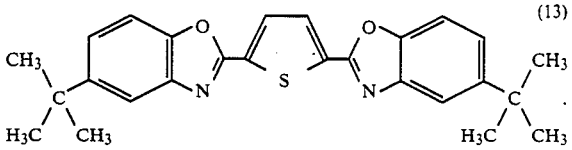

(13)

3. The photographic paper according to claim 1, wherein said oil-soluble brightening agent is added so as to be contained in an amount of 1 to 200 mg/m² in finished photographic paper.

4. The photographic paper according to claim 3, wherein said oil-soluble brightening agent is added so as to be contained in an amount of 5 to 50 mg/m² in finished photographic paper.

5. The photographic paper according to claim 1, wherein said emulsion dispersion or said latex dispersion is prepared by dissolving the oil-soluble brightening agent in a high-boiling solvent optionally together with a low-boiling solvent, and being mixed with an aqueous gelatin solution containing a surface active agent.

6. The photographic paper according to claim 5, wherein said high-boiling solvent is selected from the group consisting of di-n-butyl phthalate, di-iso-octyl phthalate, dimethoxyethyl phthalate, di-n-butyl adipate, diisooctyl azeate, tri-n-butyl citrate, butyl laurate, di-n-sebacate, tricrezyl phosphate, tri-n-butyl phosphate, triisooctyl phosphate, N,N-diethylcaprylic acid amide, N,N-dimethylpalmitic acid amide, n-butylpentadecyl phenyl ether, ethyl-2,4-tert-butyl phenyl ether, succinate, maleate and paraffin chloride.

7. The photographic paper according to claim 5, wherein said low-boiling solvent is selected from the group consisting of ethyl acetate, butyl acetate, cyclohexane, propylene carbonate, methanol, sec-butyl alcohol, tetrahydrofuran, dimethylformamide, benzene, chloroform, acetone, methyl ethyl ketone, diethyl sulfoxide and methyl cellosolve.

8. The photographic paper according to claim 5, wherein said gelatin is selected from the group consisting of alkali method gelatin, acidic method gelatin and modified gelatin.

9. The photographic paper according to claim 1, wherein said organic desensitizer is selected from the group consisting of

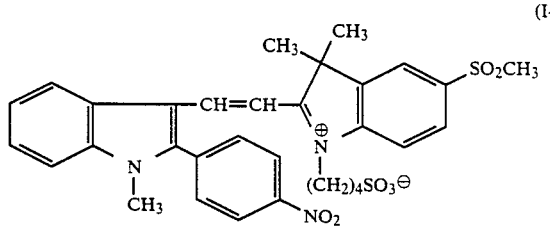

(I-4)

-continued

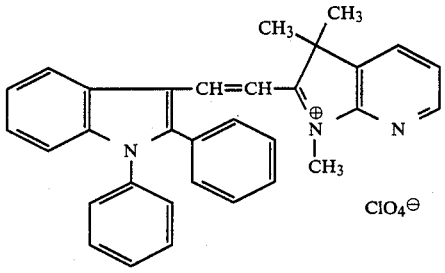

(II-1)

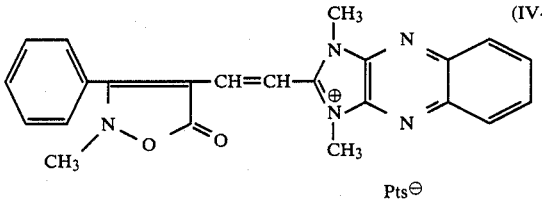

(IV-1)

and

-continued

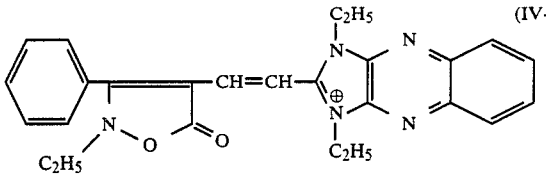

(IV-2)

10. The photographic paper according to claim 1, wherein said organic desensitizer is added in an amount of $10^{-4}$ to $10^{-2}$ mol per mol of silver halide, to a silver halide.

11. The photographic paper according to claim 1, wherein said reduction fogging agent is selected from the group consisting of formalin, hydrazine, polyamine, thiourea dioxide, tetrahydroxymethylphosphonium chloride, amine borane, boron hydrides and stannous chloride.

12. The photographic paper of claim 1 wherein said oil-soluble brightening agent is

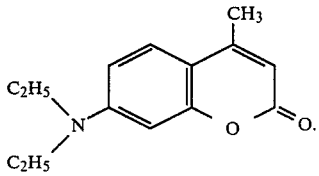

(4)

* * * * *